US009839342B2

(12) United States Patent
Welch

(10) Patent No.: US 9,839,342 B2
(45) Date of Patent: Dec. 12, 2017

(54) ANGLED DISHWASHER SUMPS

(71) Applicant: WHIRLPOOL CORPORATION, Benton Harbor, MI (US)

(72) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/924,241

(22) Filed: Oct. 27, 2015

(65) Prior Publication Data

US 2016/0113476 A1 Apr. 28, 2016

Related U.S. Application Data

(60) Provisional application No. 62/069,483, filed on Oct. 28, 2014.

(51) Int. Cl.
*A47L 15/42* (2006.01)

(52) U.S. Cl.
CPC ..... *A47L 15/4246* (2013.01)

(58) Field of Classification Search
CPC ..... A47L 15/4214; A47L 15/4219; A47L 15/4221; A47L 15/4225; A47L 15/4227; A47L 15/4246
See application file for complete search history.

(56) References Cited

U.S. PATENT DOCUMENTS

| | | | | |
|---|---|---|---|---|
| 1,995,634 | A * | 3/1935 | Clark | A47L 15/0031 134/186 |
| 3,785,566 | A * | 1/1974 | Jenkins | A47L 15/23 134/179 |
| 5,217,417 | A | 6/1993 | Zhengang | |
| 7,594,513 | B2 | 9/2009 | VanderRoest et al. | |
| 2006/0054195 | A1 * | 3/2006 | Yoon | A47L 15/4246 134/56 D |

* cited by examiner

*Primary Examiner* — David Cormier
(74) *Attorney, Agent, or Firm* — McGarry Bair PC

(57) ABSTRACT

A dishwasher for treating dishes includes a tub at least partially defining a treating chamber, the tub having a bottom portion with a sump opening therein, a liquid spraying system supplying a spray of liquid to the treating chamber, and a liquid recirculation system recirculating the sprayed liquid from the treating chamber to the liquid spraying system to define a recirculation flow path. A sump is positioned in the sump opening of the bottom of the tub within the recirculation flow path, the sump having an outlet therein located adjacent the forward portion of the sump opening. A pump has an inlet fluidly interconnected with the outlet of the sump, the pump configured to receive fluid from the outlet of the sump and impel the fluid along the recirculation flow path toward the treating chamber.

22 Claims, 9 Drawing Sheets

ANGLED DISHWASHER SUMPS

CROSS-REFERENCE TO RELATED APPLICATIONS

The present application claims the benefit of U.S. Provisional Patent Application No. 62/069,483, filed Oct. 28, 2014, which is incorporated by reference herein in its entirety.

FIELD OF THE DISCLOSURE

This disclosure relates generally to dishwashers, and, more particularly, to dishwashers with a sump positioned at the bottom of the tub.

BACKGROUND

A conventional automated home dishwasher performs cycles of operation on items present within the tub of the dishwasher and has racks and silverware baskets to hold the items. Sumps for collecting the wash water are traditionally provided at the bottom surface of the tub of the dishwasher, in a generally horizontal orientation. These sumps have collecting portions where wash water is gathered to be routed to a pump for recirculation. The pump is traditionally provided underneath the sump. In this case, the height of the pump becomes a determining factor in how much the bottom surface of the dishwasher tub can be lowered in order to maximize the capacity of the dishwasher tub.

BRIEF SUMMARY

An embodiment of the invention relates to a dishwasher for treating dishes, which comprises a tub at least partially defining a treating chamber, the tub having a bottom portion with a sump opening therein, wherein the sump opening is inclined so that a rearward portion of the sump opening is vertically offset from a forward portion of the sump opening. A liquid spraying system supplies a spray of liquid to the treating chamber. A liquid recirculation system recirculates the sprayed liquid from the treating chamber to the liquid spraying system to define a recirculation flow path. A sump is positioned in the sump opening of the bottom of the tub within the recirculation flow path, the sump having an outlet therein located adjacent the forward portion of the sump opening. A pump has an inlet fluidly interconnected with the outlet of the sump, the pump configured to receive fluid from the outlet of the sump and impel the fluid along the recirculation flow path toward the treating chamber.

DETAILED DESCRIPTION

Figure 1:
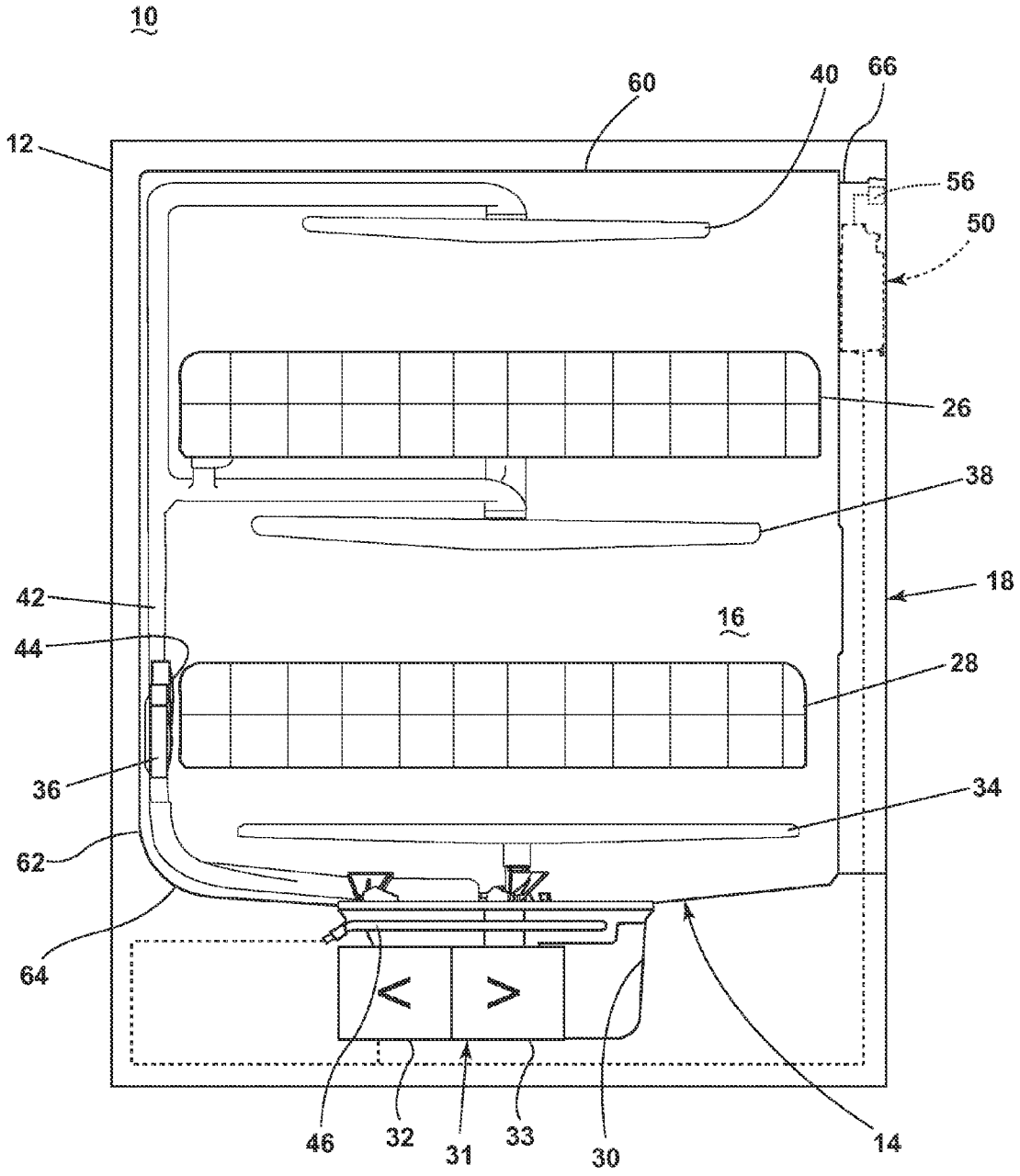
FIG. 1 is a schematic, cross-sectional view of an example dishwasher having an angled sump and pump assembly constructed in accordance with the teachings of this disclosure.

To increase dishwasher washing compartment volume, the tub bottom is often moved closer to the floor. This can make in-place, under the tub servicing (i.e., servicing without de-installing the dishwasher) more difficult. In particular, when the sump is lowered to provide more space in the washing compartment, or treating chamber, there may not be sufficient room to allow the pump to connect to the sump outside the periphery of the sump, as is conventional.

To overcome at least these problems, disclosed dishwashers having angled sumps, and pumps positioned generally beneath the higher portions of the sump are disclosed. In some examples, the sump is positioned in the rear portion of a washing compartment, and is sloped downward from the rear of the washing compartment toward the middle of the washing compartment. The sump has its greatest depth at its collecting portion, generally at the middle of the washing compartment. The low spot at the front of the sump is selected so the pump may be located beneath the higher portion of the sump. By locating the pump toward the rear and beneath the angled sump, the depth of the sump and pump combination may be reduced.

As used herein, terms such as up, down, top, bottom, side, end, front, back, etc. are used with reference to a currently considered or illustrated orientation. If it is considered with respect to another orientation, it should be understood that such terms must be correspondingly modified.

Reference will now be made in detail to embodiments of this disclosure, examples of which are illustrated in the accompanying drawings. The embodiments are described below by referring to the drawings, wherein like reference numerals refer to like elements. When like reference numerals are shown, corresponding description(s) are not repeated and the interested reader is referred to the previously discussed figure(s) for a description of the like element(s). Connecting lines, or connectors shown in the various figures presented are intended to represent example functional relationships and/or physical or logical couplings between the various elements. It should be noted that many alternative or additional functional relationships, physical connections or logical connections may be present in a practical device.

In general, identical elements are illustrated with identical reference numerals in the figures, however, for brevity the description of identically numbered elements is not repeated. In some instances identical reference numerals are omitted when their inclusion could reduce clarity and/or comprehension.

FIG. 1 is a schematic view of example automated dishwasher 10 having an angled sump with connected pump constructed in accordance with the teachings of this disclosure. In the example shown in the drawings, the angled sump is shown with a first portion adjacent a rearward portion of the bottom surface of the tub and a second portion located adjacent a lower central region of the bottom surface of the tub. Of course, it would be apparent to one skilled in the art that the angled sump according to the invention can have its first portion located adjacent any portion of the periphery of the bottom surface of the tub and a second portion vertically offset therefrom in another portion of the bottom surface of the tub. Typically, the second portion of the sump will be located adjacent a central region of the bottom surface of the tub. The example dishwasher 10 of FIG. 1 shares many features of a conventional automated dishwasher. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as an easier loading and unloading silverware basket 29. As used in this description, the term "dish(es)" is intended to be generic to any item, single or plural, that may be treated in the dishwasher 10, including, without limitation, dishes, plates, pots, bowls, pans, glassware, silverware, and utensils.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper spray assembly 40, mid-level rotatable spray assembly 38 and lower rotatable spray assembly 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513 issued Sep. 29, 2009, and titled "Multiple Wash Zone Dishwasher," which is incorporated herein by reference in its entirety.

A liquid recirculation system is provided for recirculating the sprayed liquid from the treating chamber 16 to the liquid spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33, or a single pump implementing both drain and recirculation functionality. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying to define a recirculation flow path. While not shown, a liquid supply system may include a water supply conduit coupled with a household water supply for supplying water to the treating chamber 16.

As described below and shown in FIGS. 3-16, the sump 30 is angled corresponding generally to a slope of a bottom surface 64 of the tub 14. The bottom surface 64 of the tub 14 has a circular sump opening 70 therein. The sump opening 70 is inclined so that a rearward portion of the sump opening 70 is vertically offset from a forward portion of the sump opening 70. The sump opening 70 further has a forward portion located adjacent the center or middle portion 68 of the bottom surface 64 of the tub 14, and a rearward portion located adjacent a rear portion 66 of the bottom surface 64 of the tub 14. The sump 30 is positioned in the sump opening 70 in a rear portion 66 of the bottom surface 64 of the tub 14, and is sloped downward from the rear portion 66 of the bottom surface 64 toward the middle portion 68 of the bottom surface 64 of the tub 14. The sump 30 has its greatest depth generally at a collecting portion 102 at the middle portion 68 of the bottom surface 64 of the tub 14. The low spot, or portion, at the front of the sump 30 is configured or dimensioned so the pump 31 may be fluidly coupled to that low spot and be located beneath the angled portion of the sump 30. By locating the pump 31 toward the rear and beneath the angled sump 30, the depth of the sump 30 and pump 31 combination or assembly 35 is reduced A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
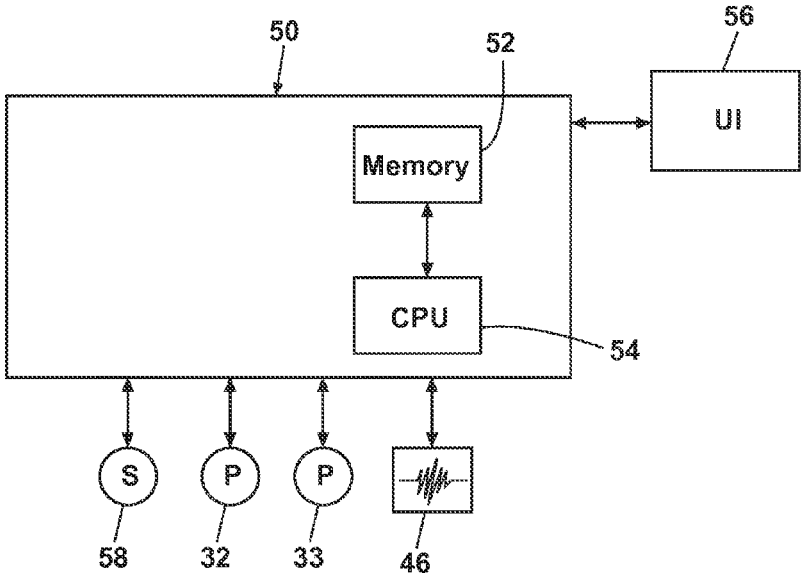
FIG. 2 is a schematic view of the example controller of the dishwasher of FIG. 1.
Figure 3:
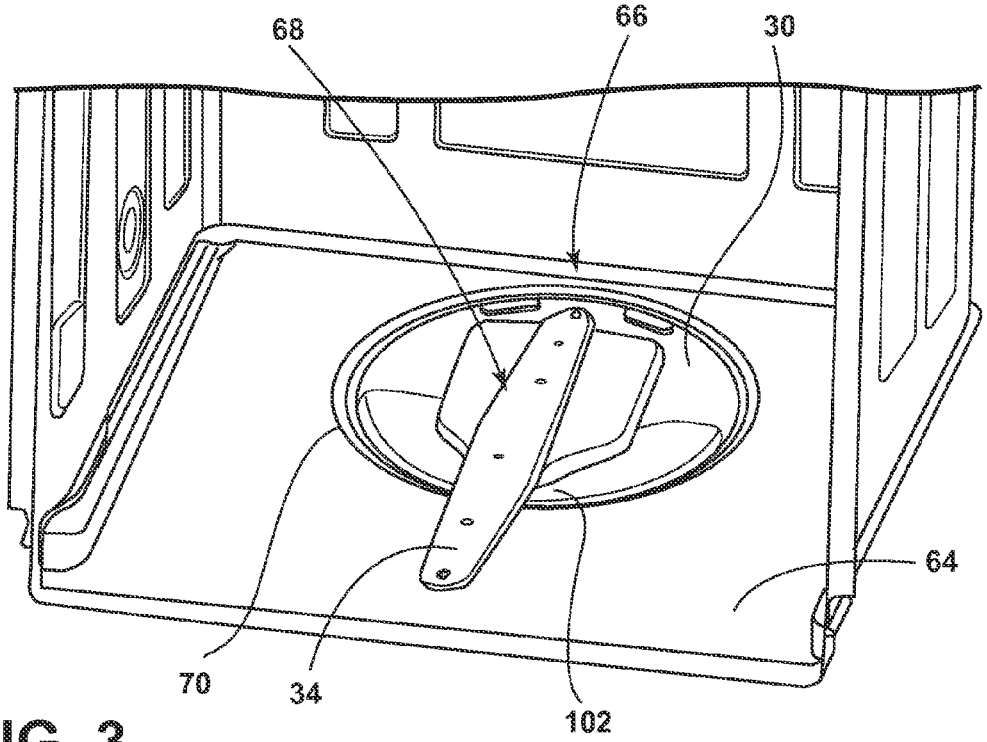
FIG. 3 is an isometric perspective view of the bottom portion of the tub of the example dishwasher of FIG. 1 having an angled sump.
Figure 4:
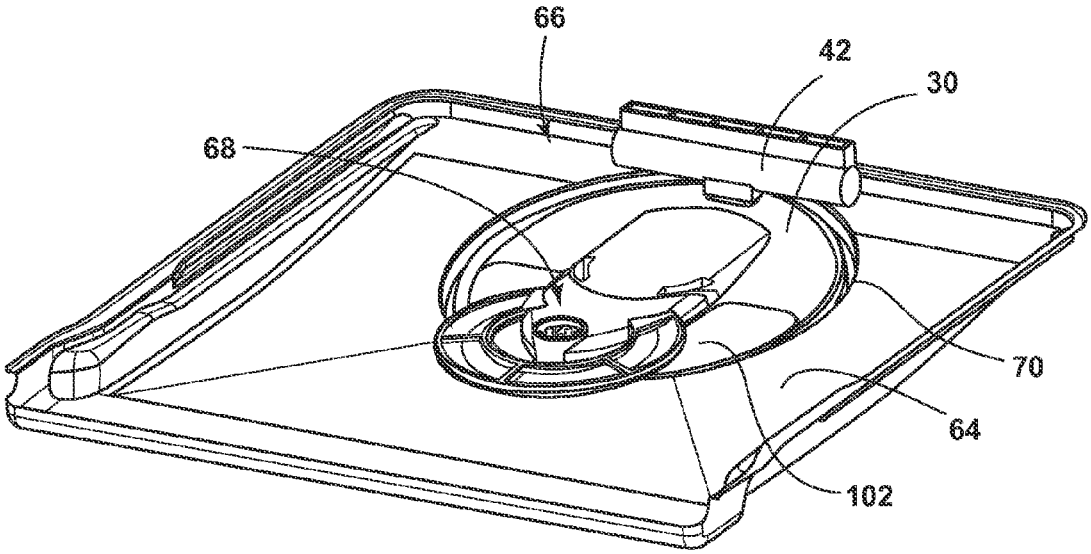
FIG. 4 is an isometric perspective view of the bottom portion of the tub of the example dishwasher of FIG. 1 having an angled sump.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control machine-readable instructions that may be executed by the CPU 54 in completing a cycle of operation using the dishwasher 10 and any additional machine-readable instructions. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 5:
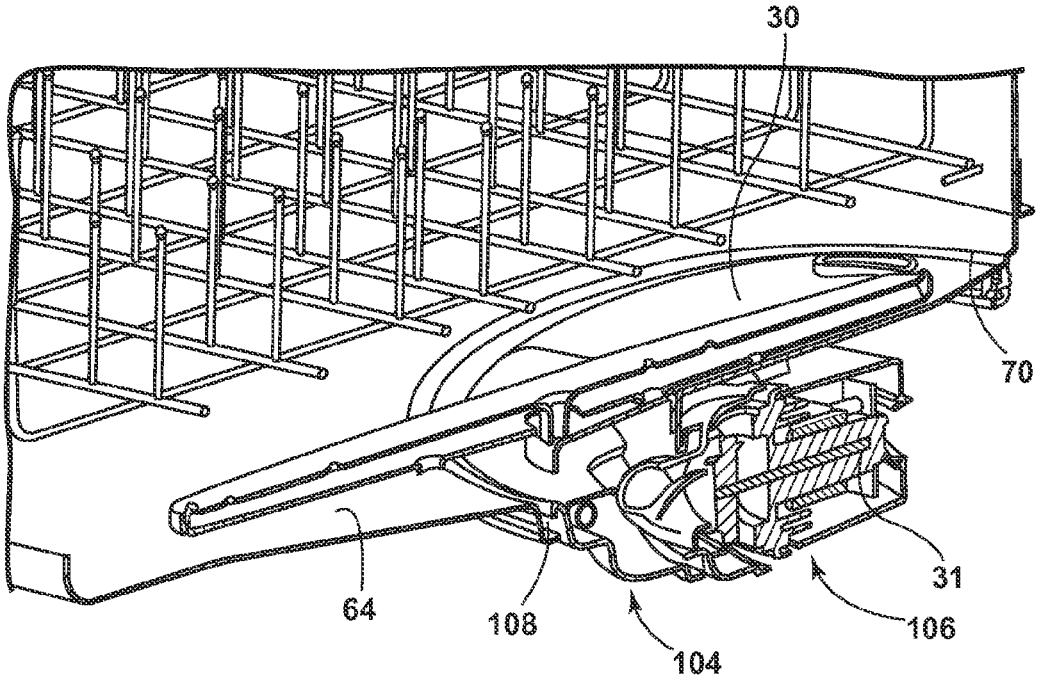
FIG. 5 is a side cross-sectional view of the bottom portion of the tub of the example dishwasher of FIG. 1 having an angled sump.
Figure 6:
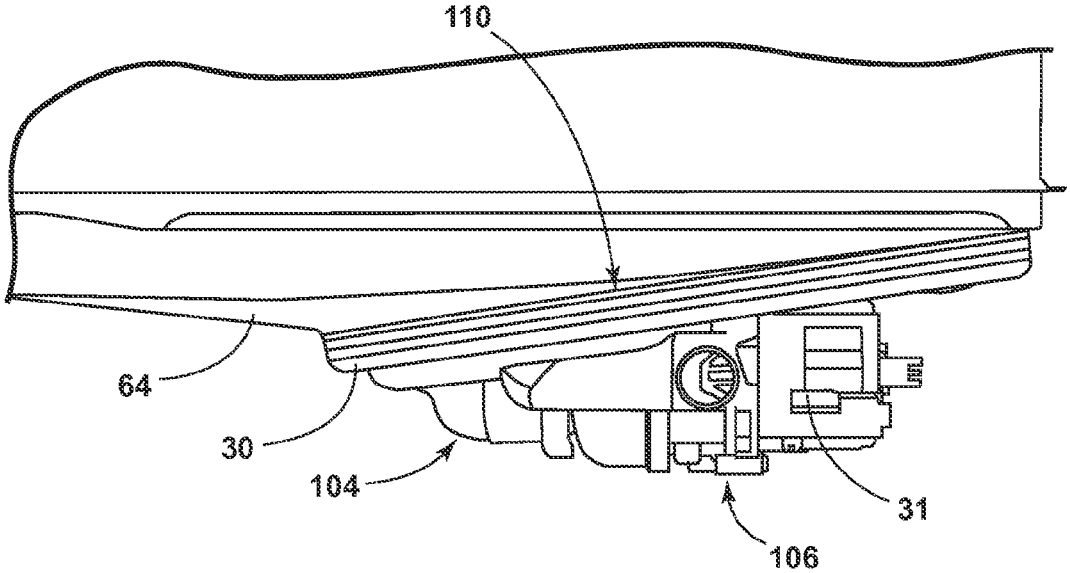
FIG. 6 is a side view of the of the bottom portion of the tub of the example dishwasher of FIG. 1 having an angled sump.

Turning to FIGS. 3-6, FIGS. 3 and 4 are isometric perspective views of the bottom portion of the tub 14 of the example dishwasher 10 of FIG. 1. FIG. 5 is a side cross-sectional view of the bottom surface 64 of the tub 14, sump 30 and pump 31, and FIG. 6 is a side view of the bottom surface 64 of the tub 14, sump 30 and pump 31. As shown, the sump 30 extends from the rear portion 66 of the bottom surface 64 of the tub 14 toward the middle portion 68 of the bottom surface 64 of the tub 14. That is, the sump 30 is not positioned about or centered on the middle portion 68 of the bottom surface 64 of the tub 14, as implemented in conventional dishwashers. Instead, the sump 30 is offset from the middle portion 68 of the bottom surface 64 of the tub 14.

The bottom surface 64 of the tub 14 slopes from the sides of the bottom surface 64 toward the low or collecting portion 102 of the sump 30 (e.g., see FIG. 4), such that the bottom surface 64 further comprises a forward portion that is vertically offset from the forward portion of the sump opening 70. The substantially lowest point 104 of the collecting portion 102 (i.e., its substantially greatest depth) is near or below the bottom 106 of the pump 31 (e.g., see FIG. 6). As shown in FIG. 6, the pump 31 extends rearward and beneath the angled sump 30. By positioning the sump 30 and pump 31 as shown, impact on tub height by the pump 31 is reduced. Moreover, by positioning the pump 31 beneath the sump 30, the pump 31 and/or other components beneath the bottom surface 64 of the tub 14 may be more easily serviced without de-installation of the dishwasher 10.

The upper edge of the gasket, or seal, 108 that fluidly seals the sump 30 to the sump opening 70 in the bottom surface 64 of the tub 14 is positioned along the angled slope 110 of the rear portion 66 of the bottom surface 64 of the tub 14. The angled upper edge of the seal 108 abuts the bottom surface 64 of the tub 14 around the sump opening 70 and receives a portion of the sump 30. In stark contrast, the sumps and gaskets, or seals, in conventional dishwashers are horizontal and centered about the middle of the bottom of the tub.

Figure 7:
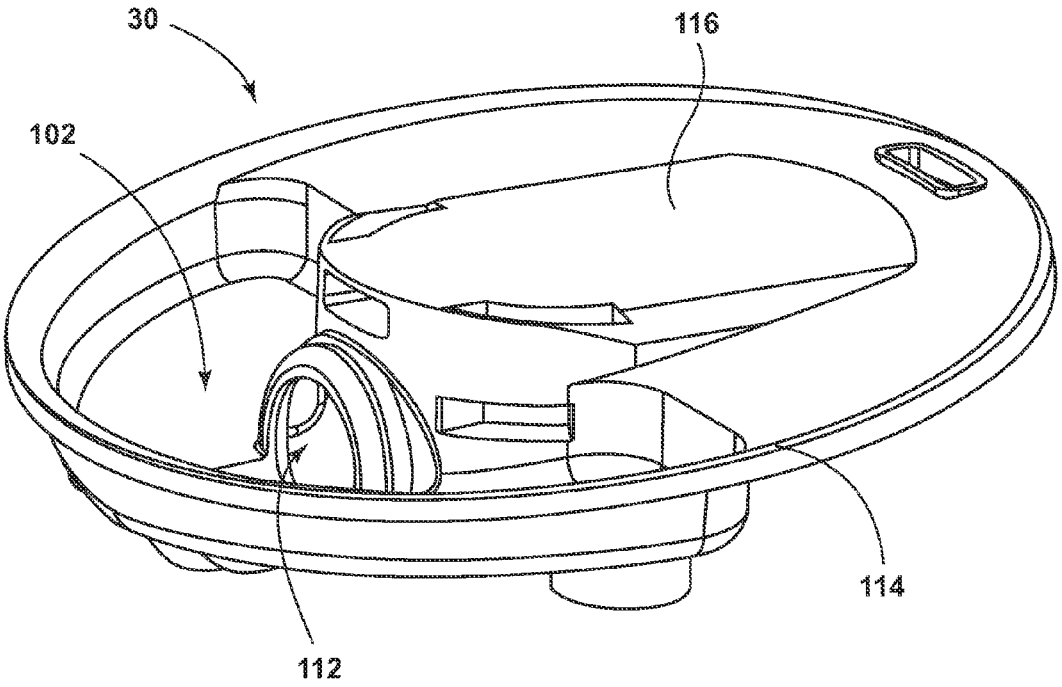
FIG. 7 is an isometric perspective view of the angled sump of FIGS. 1 and 3-6.
Figure 8:
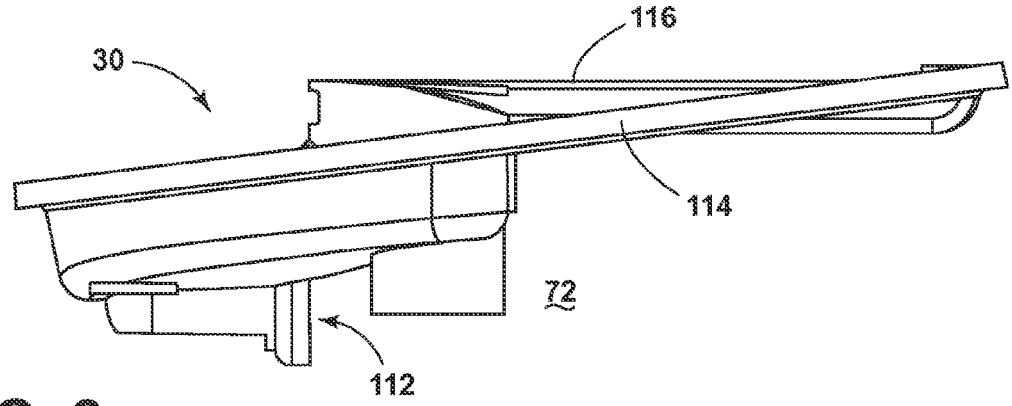
FIG. 8 is side view of the angled sump of FIGS. 1 and 3-7.
Figure 9:
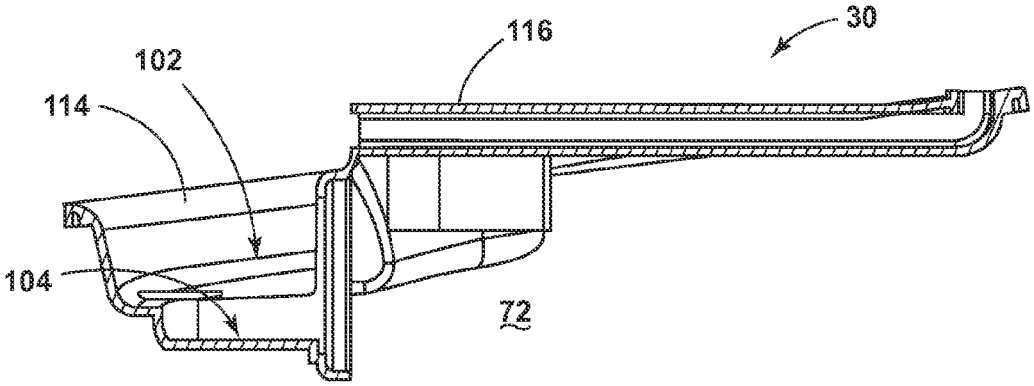
FIG. 9 is side cross-sectional view of the angled sump of FIGS. 1 and 3-8.
Figure 10:
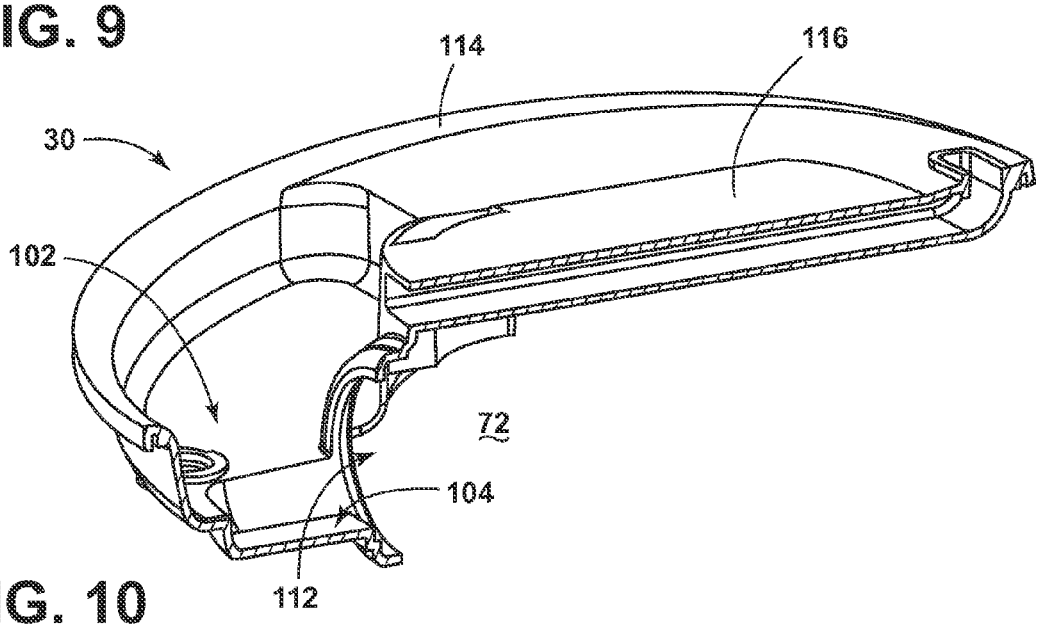
FIG. 10 is an isometric perspective cross-sectional view of the angled sump of FIGS. 1 and 3-9.
Figure 11:
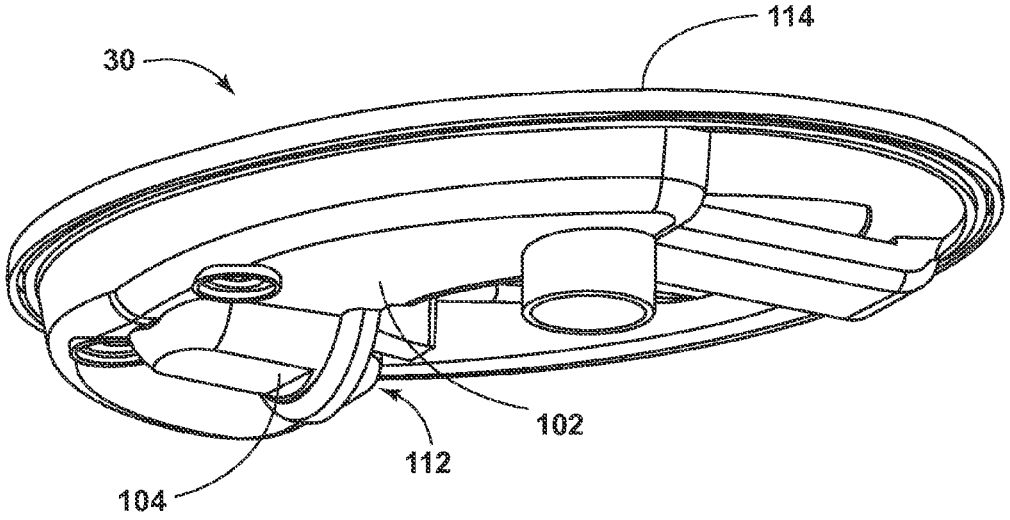
FIG. 11 is an isometric perspective view of the bottom of the angled sump of FIGS. 1 and 3-10.

Turning to FIGS. 7-11, FIG. 7 is an isometric perspective view of the example angled sump 30, FIG. 8 is side view of the example angled sump 30 in an installed orientation, FIG. 9 is side cross-sectional view of the example angled sump 30 in an installed orientation, FIG. 10 is an isometric perspective cross-sectional view of the example angled sump 30, and FIG. 11 is an isometric perspective view of the bottom of the angled sump 30.

The sump 30 has an inlet 112 to the pump 31 (not shown) from the sump 30 that is located adjacent the forward portion of the sump opening 70, in the collecting portion 102 of the sump 30 (e.g., see FIG. 7). The pump 31 via the inlet 112 receives liquid collecting in the collecting portion 102 of the sump 30. In this way, the inlet 112 to the pump 31 is also a fluidly interconnected outlet 112 from the sump 30 within the recirculation flow path. The collecting portion 102 has at least one ramped portion that descends toward the outlet 112 of the sump 30 to direct collected fluid in the collecting portion 102 of the sump 30 towards the sump outlet 112. The pump 31 is configured to receive fluid from the outlet 112 of the sump 30, which is adjacent the collecting portion 102, and impel the fluid along the recirculation flow path toward the treating chamber 16.

As shown in its installed orientation shown in FIGS. 8 and 9, the sump 30 has an upper edge 114 that is angled and is sealed by means of the seal 108 to the sloped rear portion 66 of the bottom surface 64 of the tub 14. The sump 30 has a flat or planar housing portion 116 that, when the sump 30 is positioned in the sump opening 70 of the bottom surface 64 of the tub 14, an upper portion of the planar housing portion 116 is disposed generally horizontally within the treating chamber 16. Further, a forward portion of the planar housing portion 116 extends vertically above a peripheral portion of the sump 30 when the sump 30 is positioned in an angular position within the sump opening 70. The planar housing portion 116 of the sump 30 also supports the bottom spray member 34 (e.g., see FIG. 3) and/or other portions of the liquid spraying system or other water recirculation elements by serving as a mounting surface for, for example, the bottom spray member 34.

Referring still to FIGS. 8 and 9, the sump 30 further defines a pump 31 receiving area 72 that is adjacent the outlet 112 of the sump 30 and beneath the planar housing portion 116, such that at least a portion of the pump 31 is positioned beneath the planar housing portion 116 of the sump 30 and the pump 31 inlet 112 is positioned in a fluidly interconnected manner with the outlet 112 of the sump 30.

Figure 12:
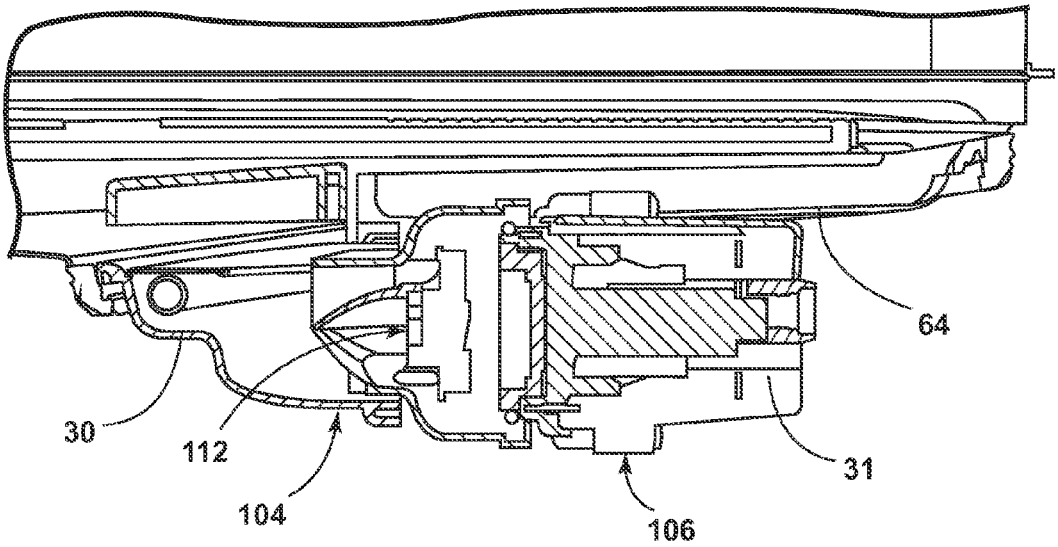
FIG. 12 is a side cross-sectional view of the angled pump and sump assembly of FIG. 1.
Figure 13:
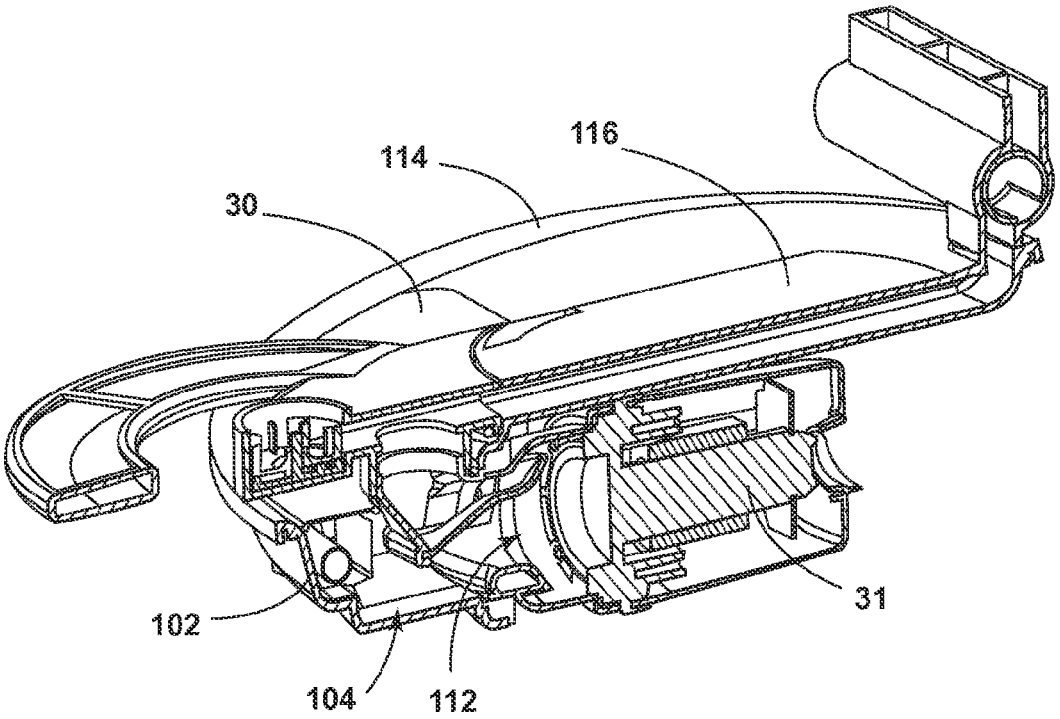
FIG. 13 is an isometric perspective side cross-sectional view of the angled pump and sump assembly of FIGS. 1 and 12.
Figure 14:
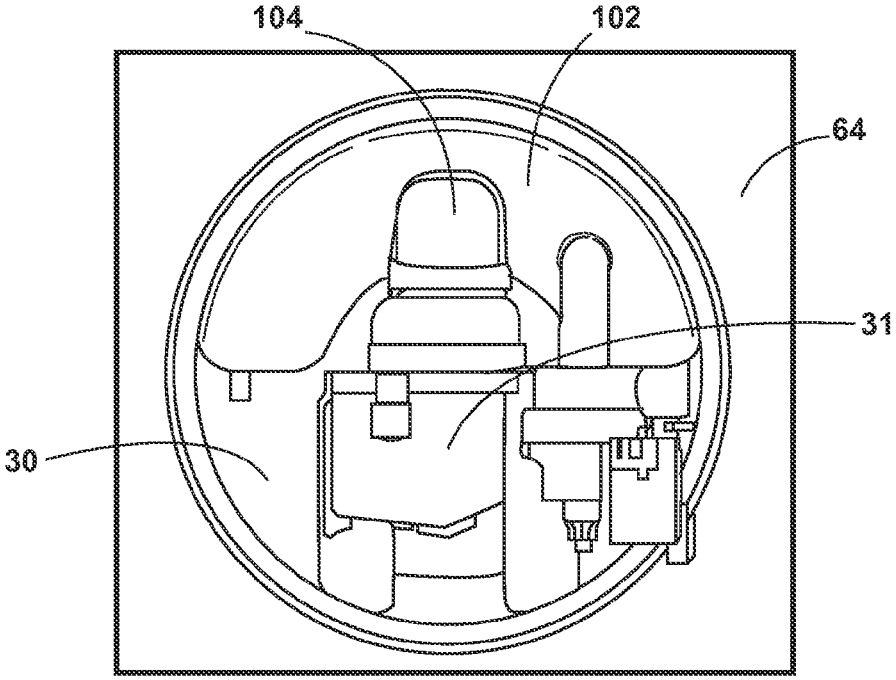
FIG. 14 is a bottom view of the angled sump and pump assembly of FIGS. 1 and 12-13.
Figure 15:
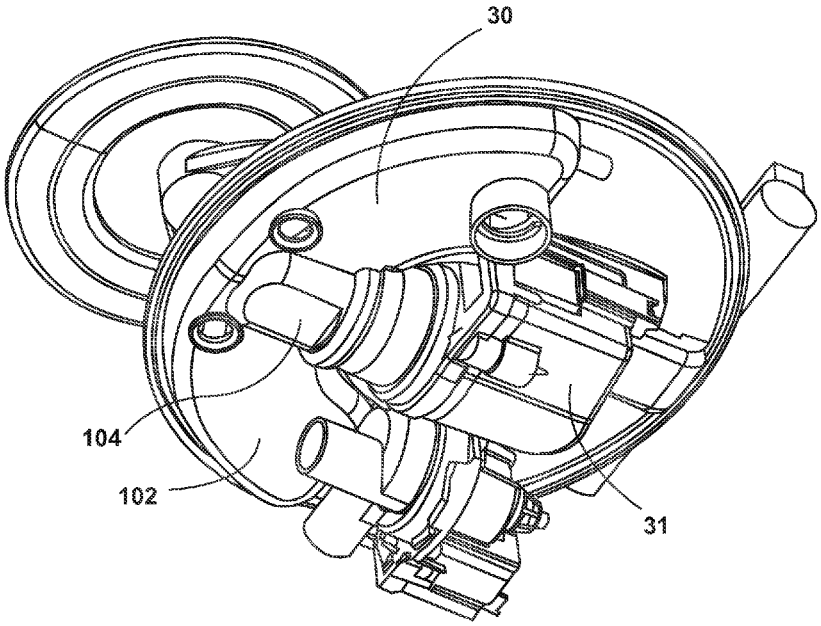
FIG. 15 is an isometric perspective view of the angled sump and pump assembly of FIGS. 1 and 12-14.

FIGS. 12-15 are additional views of the example angled pump and sump assembly of FIGS. 3-6. FIG. 12 is a side cross-sectional view, FIG. 13 is an isometric perspective side cross-sectional view, FIG. 14 is a bottom view, and FIG. 15 is an isometric perspective view. Because the salient elements of FIGS. 12-15 are discussed above in connection with FIGS. 3-11, they are not repeated here. Instead, the interested reader is referred to FIGS. 3-11 for discussion of these identical elements.

While the various aspects of the embodiment are described in a rear to front downwardly sloping context, the particular orientation and arrangement of the angled sump assembly is not limiting. For example, the highest point of the angled sump could be instead positioned at any point adjacent to the perimeter of the bottom surface of the tub such that the lowest part of the angled sump is positioned at the center of the bottom surface of the tub.

As used herein, the singular forms "a," "an" and "the" do not exclude the plural reference unless the context clearly dictates otherwise. Further, conjunctions such as "and," "or," and "and/or" used herein are inclusive unless the context clearly dictates otherwise. For example, "A and/or B" includes A alone, B alone, and A with B; "A or B" includes A with B, and "A and B" includes A alone, and B alone. Moreover, no item or component is essential to the practice of the embodiments disclosed herein unless the element is specifically described as "essential" or "critical".

Although certain examples have been described herein, the scope of coverage of this patent is not limited thereto. On the contrary, this patent covers all methods, apparatus and articles of manufacture fairly falling within the scope of the claims of this patent.

What is claimed is:

1. A dishwasher for treating dishes, comprising:

a tub at least partially defining a treating chamber, the tub having a bottom surface with a sump opening therein, wherein the sump opening is inclined to define an upper portion of the sump opening and a lower portion of the sump opening, which is vertically offset from the upper portion of the sump opening;

a liquid spraying system comprising upper and lower spray assemblies supplying selective sprays of liquid to the treating chamber;

a liquid recirculation system recirculating the sprayed liquid from the treating chamber to the upper spray assembly through a supply tube located adjacent a wall of the tub to define a recirculation flow path;

a sump assembly located in the sump opening of the bottom of the tub within the recirculation flow path and defining a sump assembly outer periphery, the sump assembly comprising:

a collecting portion located adjacent the lower portion of the sump opening and having a collecting portion wall at least partially defining the collecting portion;

an outlet located within the collection portion wall;

an upper portion of the sump assembly extending between the upper portion of the sump opening and the collecting portion wall, the upper portion of the sump assembly defining a conduit extending to the supply tube to fluidly couple the collecting portion and the supply tube; and a pump having an inlet fluidly interconnected with the outlet of the sump assembly, the pump configured to receive fluid from the outlet of the sump assembly and supply the fluid along the recirculation flow path toward the treating chamber.

2. The dishwasher of claim 1 wherein the pump is positioned entirely radially within the sump opening with the inlet of the pump directly connected with the outlet of the sump assembly.

3. The dishwasher of claim 1 wherein at least a portion of the pump is located vertically between the upper portion of the sump opening and the lower portion of the sump opening.

4. The dishwasher of claim 1 wherein the outlet of the sump assembly is formed adjacent the collecting portion.

5. The dishwasher of claim 1 wherein the collecting portion wall within which the outlet is located is a vertical collecting portion wall.

6. The dishwasher of claim 1 wherein the upper portion of the sump assembly is at least partially planar.

7. The dishwasher of claim 6 wherein at least some of the at least partially planar portion of the upper portion of the sump assembly extends vertically above a portion of the outer periphery of the sump assembly when the sump assembly is positioned in an angular position within the sump opening.

8. The dishwasher of claim 6 wherein a portion of the liquid spraying system is mounted to the at least partially planar portion of the upper portion of the sump assembly.

9. The dishwasher of claim 8 wherein the portion of the liquid spraying system that is mounted to the at least partially planar portion of the upper portion of the sump assembly is at least one of the lower spray assembly or the supply tube, and the at least one of the lower spray assembly or the supply tube is supported by the at least partially planar portion of the upper portion of the sump assembly.

10. The dishwasher of claim 1 wherein the collecting portion wall is located where the upper portion of the sump assembly and the collecting portion abut one another.

11. The dishwasher of claim 1 wherein the pump is positioned within the sump assembly outer periphery and the inlet of the pump is directly connected with the outlet of the sump assembly.

12. The dishwasher of claim 6 wherein the at least partially planar portion of the upper portion of the sump assembly extends inwardly past a midpoint of the sump assembly outer periphery.

13. The dishwasher of claim 1 wherein the tub has an open face that is selectively opened and closed by a door assembly to provide access to the treating chamber.

14. The dishwasher of claim 13 wherein the lower portion of the sump opening is closer to the open face of the tub than the upper portion of the sump opening.

15. The dishwasher of claim 1 wherein the bottom of the tub further comprises a peripheral portion vertically offset from the lower portion of the sump opening.

16. The dishwasher of claim 1 further comprising a seal between the sump assembly and the sump opening.

17. The dishwasher of claim 16 wherein the seal has an angled upper edge thereon, and the angled upper edge of the seal abuts the bottom of the tub around the sump opening and receives a portion of the sump assembly.

18. The dishwasher of claim 1 wherein when the sump assembly is positioned in the sump opening of the bottom of the tub, at least a portion of the upper portion of the sump assembly is disposed horizontally within the treating chamber.

19. The dishwasher of claim 1 wherein the sump assembly further defines a pump receiving area adjacent the outlet of the sump assembly and beneath the upper portion of the sump assembly, wherein at least a portion of the pump is positioned beneath the upper portion of the sump assembly and the pump inlet is positioned adjacent the outlet of the sump assembly.

20. The dishwasher of claim 1 wherein the collecting portion has at least one ramped portion that descends toward the outlet of the sump assembly to direct collected fluid in the collecting portion of the sump assembly toward the sump assembly outlet.

21. The dishwasher of claim 1 wherein the lower portion of the sump opening is located adjacent a center portion of the bottom of the tub, and the upper portion of the sump opening is located adjacent a rear portion of the bottom of the tub.

22. The dishwasher of claim 1 wherein the sump opening is circular.

* * * * *